United States Patent [19]

Messner et al.

[11] 3,948,748

[45] Apr. 6, 1976

[54] APPARATUS FOR THE PRODUCTION OF ALKALI METAL CHLORATES

[75] Inventors: Georg Messner, Munich, Germany; Vittorio De Nora, Nassau, Bahamas

[73] Assignee: Oronzio de Nora Impianti Elettrochimici S.p.A., Milan, Italy

[22] Filed: Nov. 21, 1973

[21] Appl. No.: 417,790

Related U.S. Application Data

[62] Division of Ser. No. 238,804, March 28, 1972, Pat. No. 3,809,629.

[52] U.S. Cl. ..... 204/270; 204/95; 204/236; 204/268; 204/278

[51] Int. Cl.[2] ..... C01B 11/26

[58] Field of Search ..... 204/95, 236, 268, 270, 204/278

[56] References Cited

UNITED STATES PATENTS

| | | | |
|---|---|---|---|
| 3,489,667 | 1/1970 | Colman et al. | 204/268 |
| 3,755,105 | 8/1973 | Messner | 204/268 X |
| 3,759,815 | 9/1973 | Larsson | 204/268 |
| 3,766,044 | 10/1973 | Westerlund | 204/268 |
| 3,785,951 | 1/1974 | Fleck | 204/268 |
| 3,791,947 | 2/1974 | Loftfield | 204/95 |

FOREIGN PATENTS OR APPLICATIONS

| | | | |
|---|---|---|---|
| 667,774 | 3/1952 | United Kingdom | 204/270 |

*Primary Examiner*—Howard S. Williams
*Assistant Examiner*—A. C. Prescott
*Attorney, Agent, or Firm*—Hammond & Littell

[57] ABSTRACT

An apparatus for increasing percentage yield concurrent with increased current efficiency in electrolytic conversion of alkali metal chloride in an electrolyzer into alkali metal chlorate and formation of the chlorate by chemical disproportionation in separate chlorate formation zones, the use of bipolar electrolyzers is preferred but not necessary.

14 Claims, 10 Drawing Figures

FIG. 2
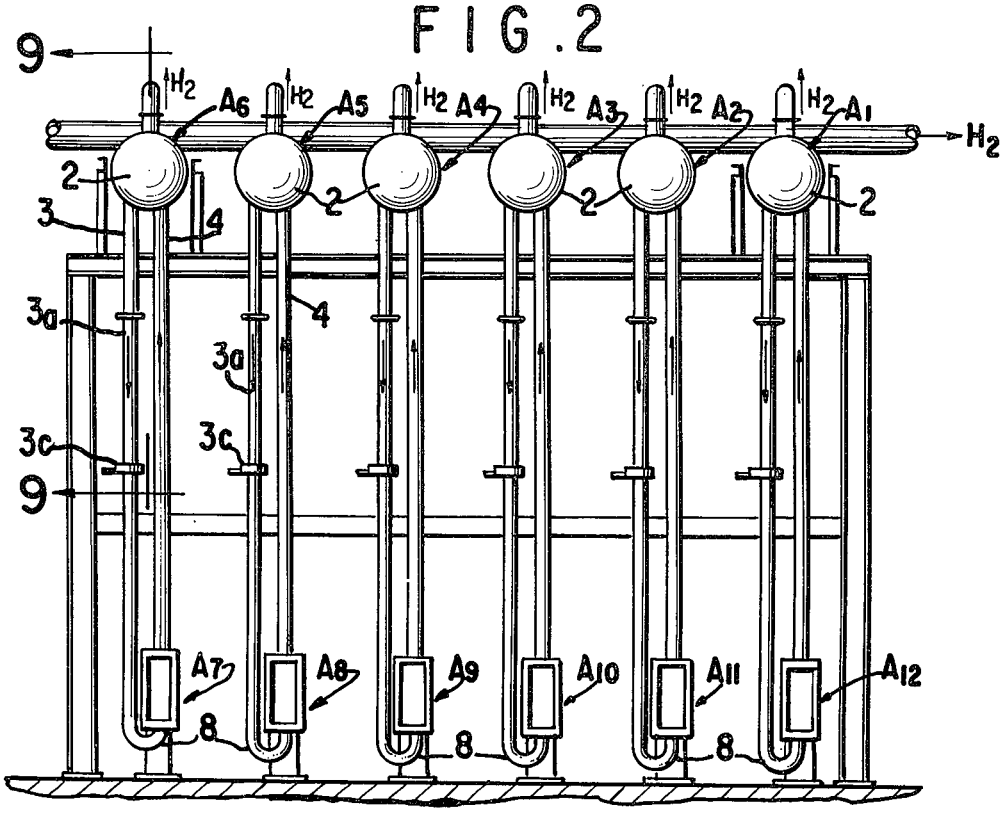
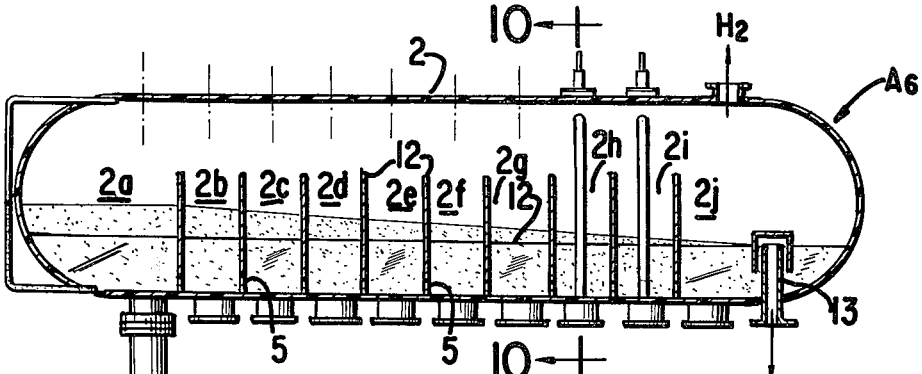
FIG. 9
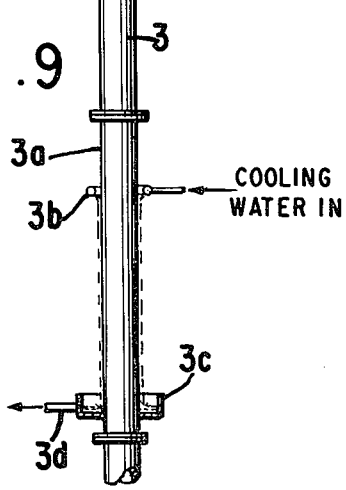
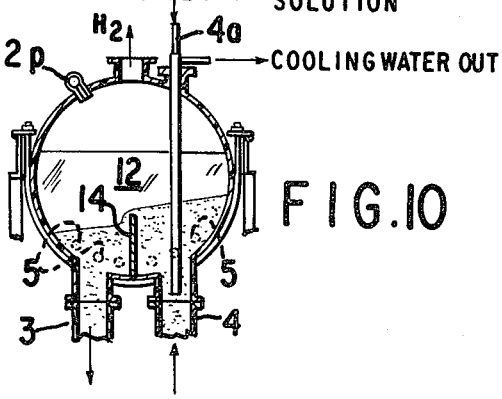
FIG. 10

APPARATUS FOR THE PRODUCTION OF ALKALI METAL CHLORATES

This is a division of Ser. No. 238,804, filed Mar. 28, 1972, now U.S. Pat. No. 3,809,629.

This invention relates to an improved electrolyzer plant for the production of chlorate from an alkali metal chloride such as aqueous solutions of sodium or potassium chloride at an acid pH.

BACKGROUND

Prior to this invention, alkali metal chlorates were typically produced in separate unipolar electrolyzer cells connected in electrical parallel, such as illustrated and described, for example, in U.S. Pat. No. 3,539,486, with the feed electrolyte solution of the cells being circulated and recirculated to and from a single reactor vessel. The chlorate concentration within the reactor vessel was permitted to build up and was maintained at a high concentration, and a small amont of electrolyte was continuously withdrawn to the precipitator crystallizer system, where by lowered temperature chlorate crystals were crystallized and separated from the alkali metal chloride solution which was returned to the electrolyzer cells. In these systems, the cell covers were provided with a gas duct system to vent the by-product gas, such as hydrogen contaminated with oxygen and chlorine, to the atmosphere or to a recovery and purification system. Other cells were sealed and operated with a high hydrogen content in the vent gas. Also, some prior systems made use of bipolar cells, introducing current into a terminal cell anode of a series of the bipolar cells, and the current leaving from a cathode of the terminal cell at the opposite end of the series For sodium chlorate production, usual current densities range from about 1,000 to 3,000 amperes per square meter, giving operating temperatures of about 60° to 65° C, but cathode densities may vary from about 500 to 2,000 A/m$^2$ and anode current densities from about 500 to 4,000 A/m$^2$. With smooth platinum anodes, a current efficiency of about 85% to 90% has been obtainable, and with platinized platinum, up to about 99% current efficiency.

In such systems, current efficiency improves at temperatures ranging downward to about 30° C, with most cells operating within the range of 35° to 45° C, because of the greater wear on graphite anodes at the higher temperatures. Increases in current densities tends to increase voltage drop across a cell but to improve current efficiency and also to increase the rate of attack on graphite anodes per unit of time but to decrease attack on the graphite per unit of chlorate produced. In such systems, the current efficiency for sodium chlorate is about 80 to 85%, normally on a basis of a cell voltage of 3.6 with an energy expenditure of about 2.4 to 3 kwh/lb chlorate. It has also been customary to add chromate to passivate iron cathodes and other iron portions of the cell and reduce corrosion and to add HCl to maintain the electrolyte on the acid side.

Although current efficiency is improved at lower temperatures, the velocity of reaction of hypochlorous acid with sodium hypochlorite to form chlorate is known to increase particularly at temperatures about 70° C. The chemical formation of chlorate takes place throughout the whole volume of the electrolyte and, therefore, it is recognized the current efficiency and chemical formation of chlorate are improved by greater current concentration per given area, and increasing electrolyte volume increases current efficiency.

In typical prior art systems, the space for electrolyte volume between anode and cathode surfaces (electrolyte gap) usually ranges between 0.25 to 0.5 in. (0.6 to 1.2 cm).

The chlorate industry is highly competitive and with increase in demand for sodium and potassium chlorate, it has become increasingly important to effect improvements in the apparatus and process of producing these chlorates, particularly sodium chlorate, to reduce the cost of production. However, there are complicating factors involved, such as higher current density normally resulting in higher cost of production, whereas at lower temperatures although current efficiency is increased, the rate of chemical formation of chlorate from hypochlorous acid and the hypochlorite ion decreases, i.e., the rate of chemical disproportionation decreases. In order to efficiently remove the chlorate by crystallization, it has been necessary either to operate the reactor and recirculated electrolyte solution at a high chlorate concentration and simultaneously the maximum level of sodium chloride, or to operate with a series of unipolar cells with the flowing electrolyte forming a cascade from cell to cell. Because of the necessarily high chlorate concentration in the first case, as well as the merely minor increase in chlorate concentration resulting from any one cell, high chlorate concentration has been a controlling factor with no apparent significant regard to the effect that this has on the efficiency of electrolytic decomposition of the sodium chloride. Also, although current efficiencies are greater at lower temperatures, the corresponding decrease in the rate of the disproportionation reaction requires a greater time of production of a given amount of chlorate with a corresponding increase in overhead costs per unit of time increase in direct proportion to additional time required for production of a given quantity of chlorate.

OBJECTS OF THIS INVENTION

One of the objects of this invention is to provide a more efficient and low cost apparatus for producing alkali metal chlorates.

Another object is to provide an apparatus for producing alkali metal chlorates in which an aqueous solution of an alkali metal chloride is passed between interleaved metal anodes and cathodes in a series of bipolar cell units, with recirculation of the electrolyte solution through each cell unit and through the series of cells to provide the needed time for chlorate formation with less expenditure of electrical power.

Another object of the invention is to provide apparatus as described above, for carrying out the necessary reactions for chlorate formation and removal of the gaseous reaction product under superatmospheric pressure.

Another object of the invention is to provide apparatus which will produce a more uniform concentration of alkali metal chlorate in the electrolyzer solution fed to the chlorate recovery system.

Various other objects and advantages of this invention will appear as this description proceeds.

SUMMARY OF THE INVENTION

This invention provides an apparatus in which the concentrated sodium chloride solution of one cell unit of a bipolar series is recirculated substantially solely through that one cell unit for a number of times, while a small portion thereof is bled off into an adjacent circulating cell unit of the electrolyzer system, where, again, there are a number of repeated recirculations through the second cell unit, except for a small amount that is continuously bled off to a third cell, etc., through a number of cells, preferably in bipolar connection. While bipolar connected cells are shown and preferred, it will be understood that the individual cells may be separate unipolar cells.

There may be a large number of cells in such a series electrolyzer, receiving their total circulating electrolyte from the bleed off of a prior cell in the electrolyzer series; the first cell of such an electrolyzer series is the one into which initial sodium chloride feed is made (although variations of the process may feed more than one cell, such as from opposite ends of the series and withdrawing from an intermediate cell). Normally, only the last cell of the electrolyzer series does not feed another cell, but at the same rate of bleed, feeds the conduit leading to a chlorate recovery or chlorate consumer system (such as, for example, a chlorine dioxide plant). By this method, the earlier cells in the electrolyzer series have the advantage of higher sodium chloride concentration as well as low chlorate concentration, while the latter cells have the advantage of the high chlorate concentration needed for cyrstallization of chlorate from the withdrawn portion from the last cell of a series. One of the advantages of this invention is that substantially every portion of withdrawn chlorate containing solution has been subjected to repeated recycling through each of the elements of a bipolar or a monopolar cell series before being withdrawn, whereby each volume of aqueous electrolyte and the reaction intermediates have been subjected to a long reaction period, there being substantially no opportunity for any portion of the initial feed and/or intermediates to move directly to the last cell's withdrawal point without passing through repeated cycles of circulation in each of the electrolyzer cells. As all the cells are preferably in bipolar connection, there is a minimum loss of electrical power through internal resistance losses, although each of the cells may be unipolar and separately connected in a series connection by merely separating the individual cells shown herein in bipolar connection and providing connection between each cell.

Although it has been known heretofore that a prolonged reaction time results in a higher efficiency of chlorate production, no practical and economical apparatus capable of achieving this end, while avoiding other difficulties discussed above, has been heretofore available. The high concentration of sodium chloride and low concentration of chlorate and other intermediates in the earlier cell units result in a greater sodium chloride concentration with higher conductivity and current efficiency. The last cell of the electrolyzer series is the least efficient in energy consumption, considering these factors, but the last cell of the electrolyzer series is nevertheless equivalent in production to what might be realized by the total cells of the prior art. The earlier cells enhance the production of chlorate, reducing cost by increased yield resulting from the several factors discussed above. The apparatus of this invention incorporating the bipolar cell arrangement as a part thereof, produce advantages not available in the prior art. The use of bipolar cells avoids increased resistance and resulting voltage drop, thereby reducing costs which are incurred in the use of separate cells in parallel, or of cells in electrical circuits other than bipolar.

Another feature of the invention includes the use of a substantial amount of electrolyte head above the anode and cathode plates of the electrolyzers, thereby providing a substantial pressure in the cells which serves to restrain the volume of hydrogen and other gas bubbles which otherwise reduce cell efficiency to the extent that the volume of the gas bubbles is large enough to increase the resistance of the electrolyte to the passage of current between the anodes and cathodes. The use of titanium anodes provided with electric conducting electrocatalytic coatings, steel cathodes and contact between the bipolar electrodes is a further feature of this invention, in further serving to improve efficiency and operation of the overall apparatus and process. By virtue of the substantial electrolyte head and the nearly dense gas free down-comer electrolyte flow into the electrolyzer cells and the hydrogen gas containing less dense up-comer electrolyte flow from the top of the cell, the efficiency of the cells is improved, so that a higher temperature of operation (within a temperature range of about 70° C to about 90° C) is employable even though ordinarily such high operating temperature would be accompanied by a substantial increase in cell voltage.

The overall effect of the novel apparatus of this invention results in an electrolyzer plant for chlorate production having a level of efficiency, low cost and simplicity in assembling and disassembling heretofore unheard of in this industry.

DESCRIPTION OF FIGURES

In the accompanying drawings which illustrate one form of the many embodiments the invention may take:

FIG. 2 is a side view taken from the right side of FIG. 1, as indicated by the arrow 2;

FIG. 9 is a part sectional side view of a reactor gas separation tank, taken substantially along the line 9—9 of FIG. 2; and FIG. 10 is a cross sectional view taken along the line 10 — 10 of FIG. 9.

DETAILED DESCRIPTION

Figure 1:
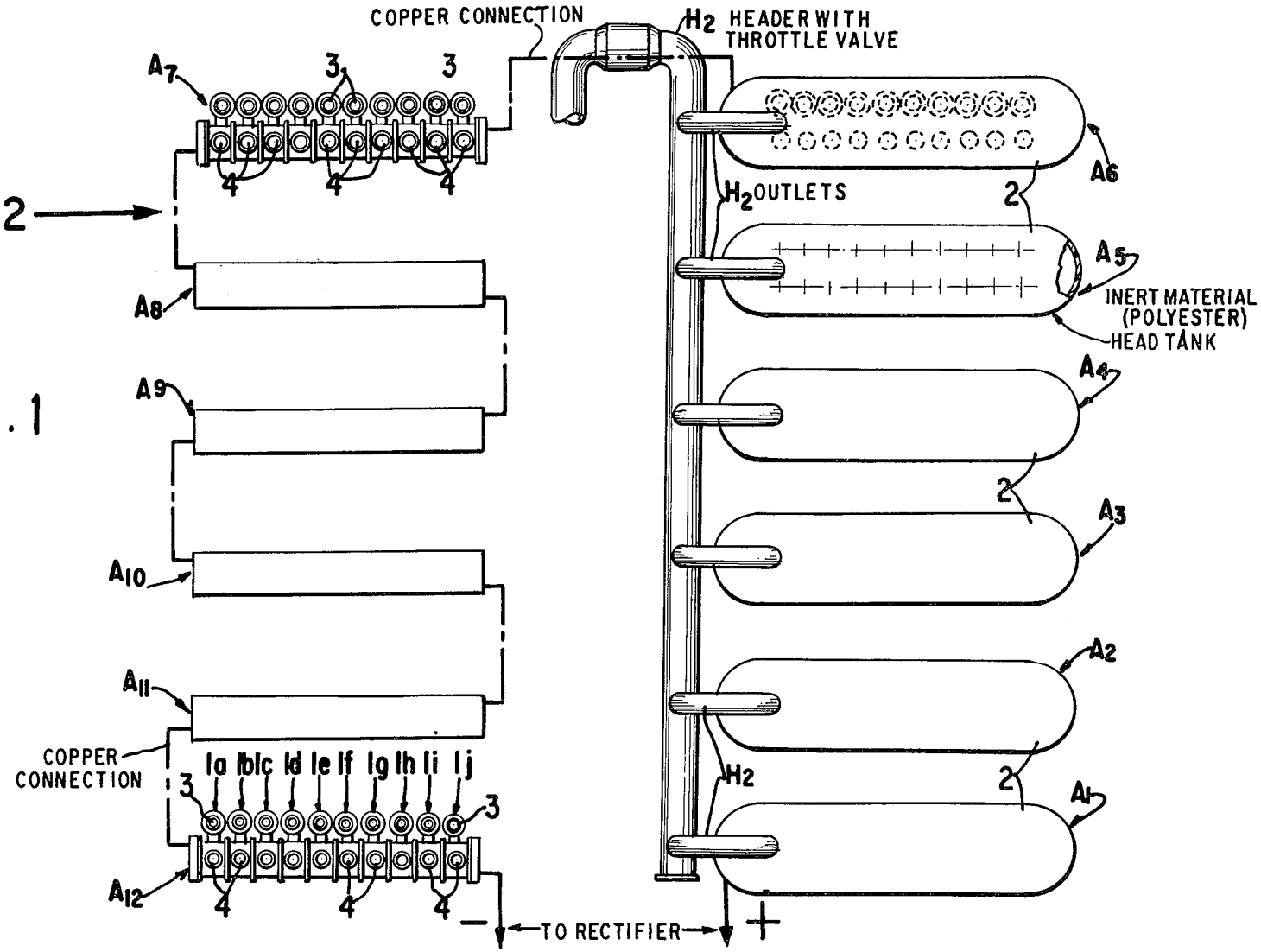
FIG. 1 is a view of a chlorate plant showing six bipolar chlorate electrolyzers on the right side in plan view, and six bipolar chlorate electrolyzers in part sectional view on the left side, with the twelve electrolyzers connected in series.
Figure 3:
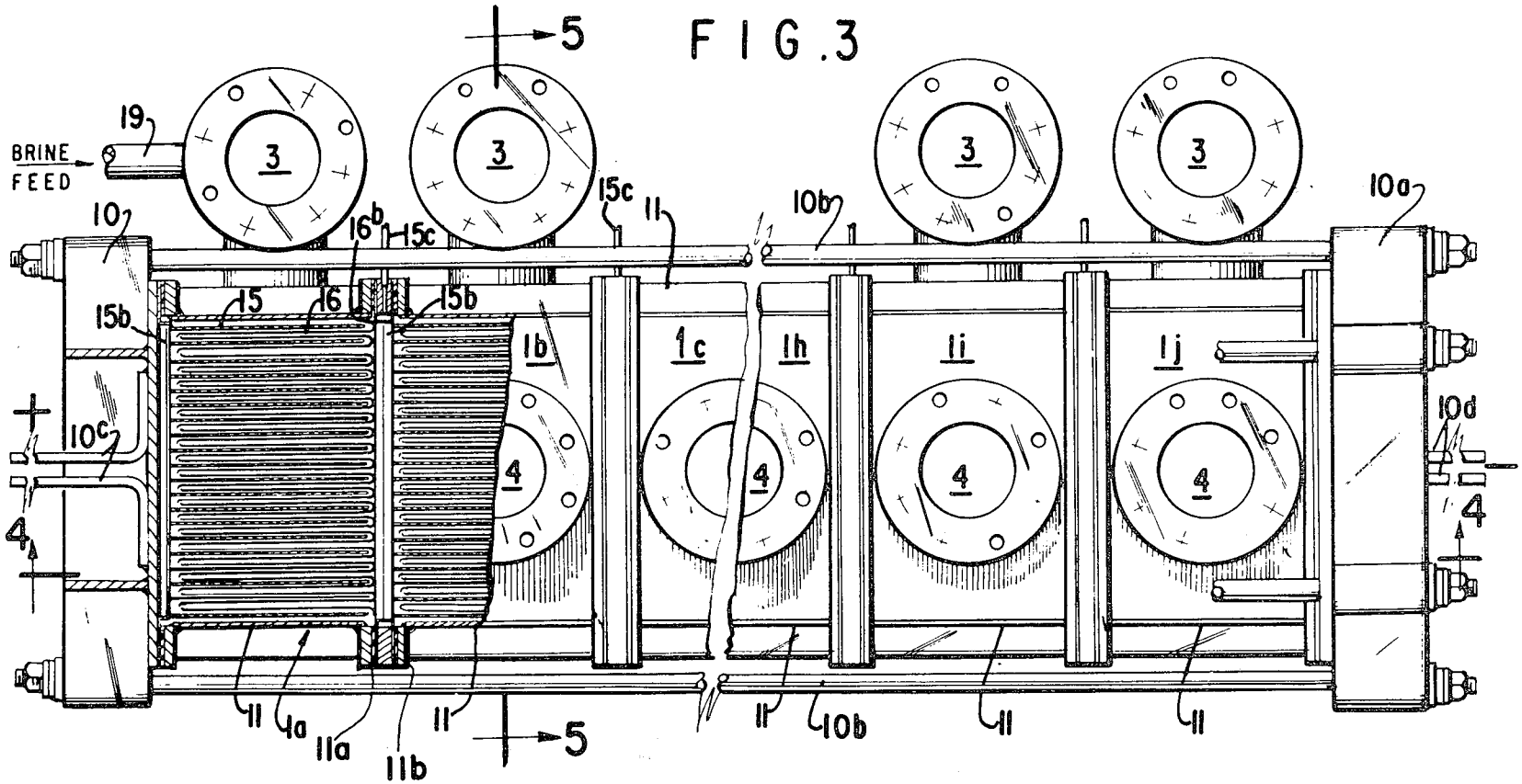
FIG. 3 is an enlarged part sectional plan view of one bipolar chlorate electrolyzer, such as shown on the left side of FIG. 1.

In the illustrative embodiment of plant layout shown in FIG. 1, six bipolar chlorate electrolyzers A1 to A6 are shown in plan view on the right side and six electrolyzers, A7 to A12, are shown in part sectional plan view on the left side. Each of the electrolyzers, A1 to A12, are made up of a plurality of bipolar cell units 1*a*, 1*b*, 1*c*, to 1*j*, as illustrated in FIG. 3, and at the lower left side of FIG. 1. An electrolyzer may consist of ten or more such units in bipolar connection. The bipolar cell units of each of the electrolyzers A1 to A12 are connected in series to a suitable source of d.c. current, as shown by the (+) and (−) signs and the dash-dot lines connecting the electrolyzers A1 to A12 in FIG. 1.

Above each of the electrolyzers A1 to A12, a reactor gas separation tank, illustrated in greater detail in FIGS. 2 and 9, receives the reaction products of the electrolysis and separates the gas from the liquid portion thereof. The reaction products rise from the electrolyzer cell units 1*a* to 1*j* through up-comer pipes 4 and the liquid portion is returned to the electrolyzer cell units through down-comer pipes 3.

The pipes 3 and 4 and the gas separation tanks 2 are made of glass or other chemically inert and electrically insulating materal, such as polyvinyl chloride, and the tanks 2 are mounted about 8 to 10 meters or more above the electrolyzer units 1*a* to 1*j*, to provide a pressure head of about 1 to 2 atm. on the electrolyte in the electrolyzer cell units. The pipes 3 and 4 are connected to each of the bipolar cell units 1*a*, 1*b*, etc., by Teflon bellows 6 and 6*a*, by means of disconnectable flanges 7 and 7*a* (FIG. 4), so as to allow for expansion and contraction of pipes 3 and 4 in use and permit ready disconnection of any cell unit 1*a*, 1*b*, to 1*g* for replacement or repair. In case of such disconnection of a particular electrolyzer, the electrical circuit is short circuited to the next connected electrolyzer, and the entire electrolyzer mounted on a tram car which may be wheeled to the repair area.

The hydrogen released from the circulating electrolyte in the tanks 2 flows from the hydrogen outlets marked $H_2$ and into a hydrogen header to the hydrogen recovery system. As indicated at the top of FIG. 1, the $H_2$ header may be provided with a throttle valve to build up a hydrogen pressure above atmospheric to still further increase the overpressure on the electrolyte in the cell units 1a, 1b, etc.

The separation tanks 2 are provided with separation partitions 12 corresponding in number to the number of separate cell units 1*a* to 1*j*, and each partition has small openings 5 through which a regulated amount of electrolyte may flow from the electrolyte circuits of cell units 1a to the electrolyte circuit of units 1*b* and finally to the electrolyte circuit of cell units 1*j*. The electrolyte containing the maximum amount of chlorate in solution flows from the outlets 13 of each tank 2 to the chlorate crystallization or utilization system. A barrier 14 is provided in each area 2*a*, 2*b*, etc. of the tanks 2 to prevent short circuiting of the electrolyte between the up-comer and down-comer pipes 4 and 3, and provides greater time for the escape of the hydrogen from the electrolyte. Instead of openings 5 any other means to pass a regulated amount of electrolyte from the circuit of one cell unit 1a to the next adjacent cell 1b, may be provided.

Figure 4:
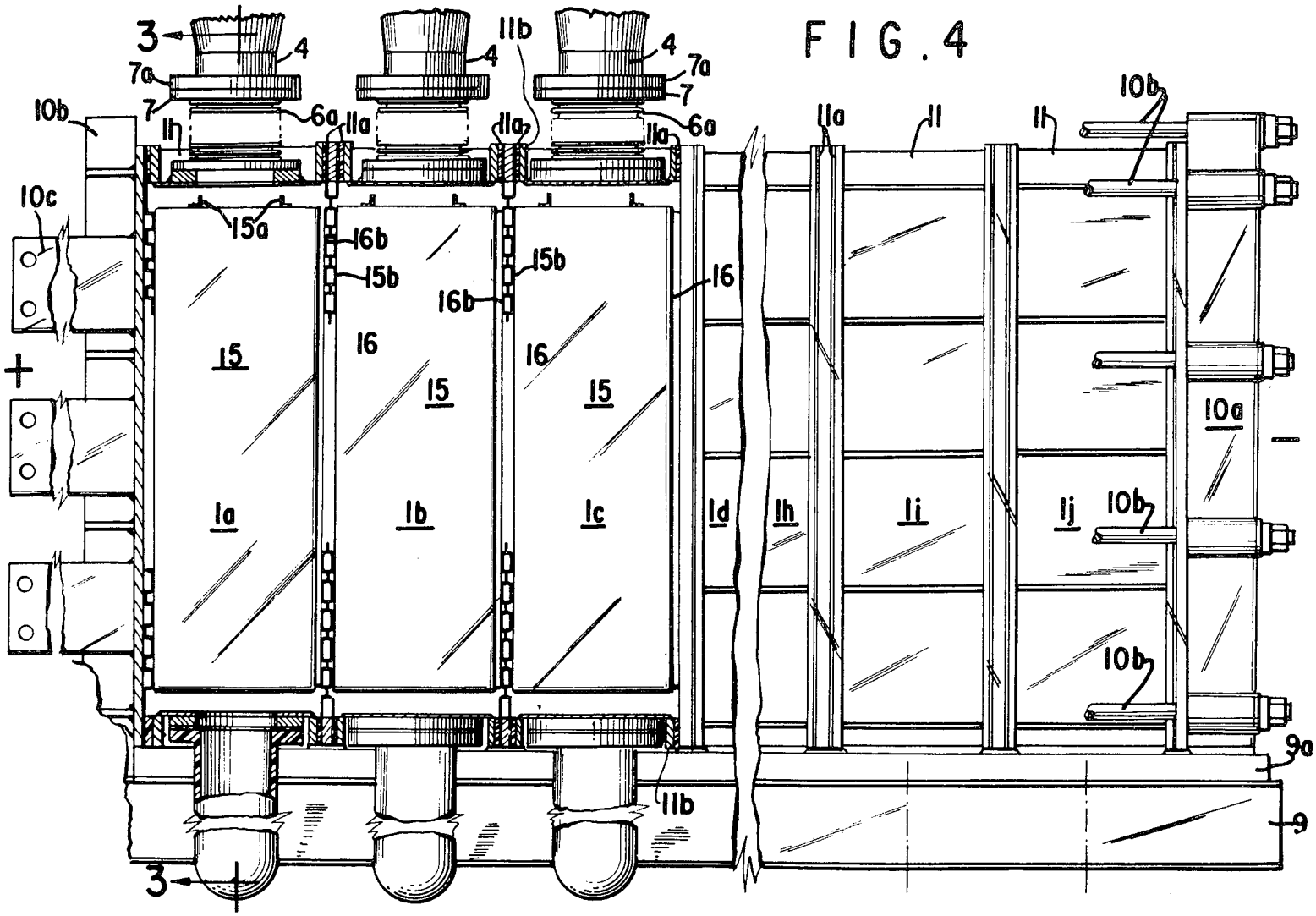
FIG. 4 is a vertical sectional view taken substantially along the line 4 — 4 of FIG. 3.
Figure 5:
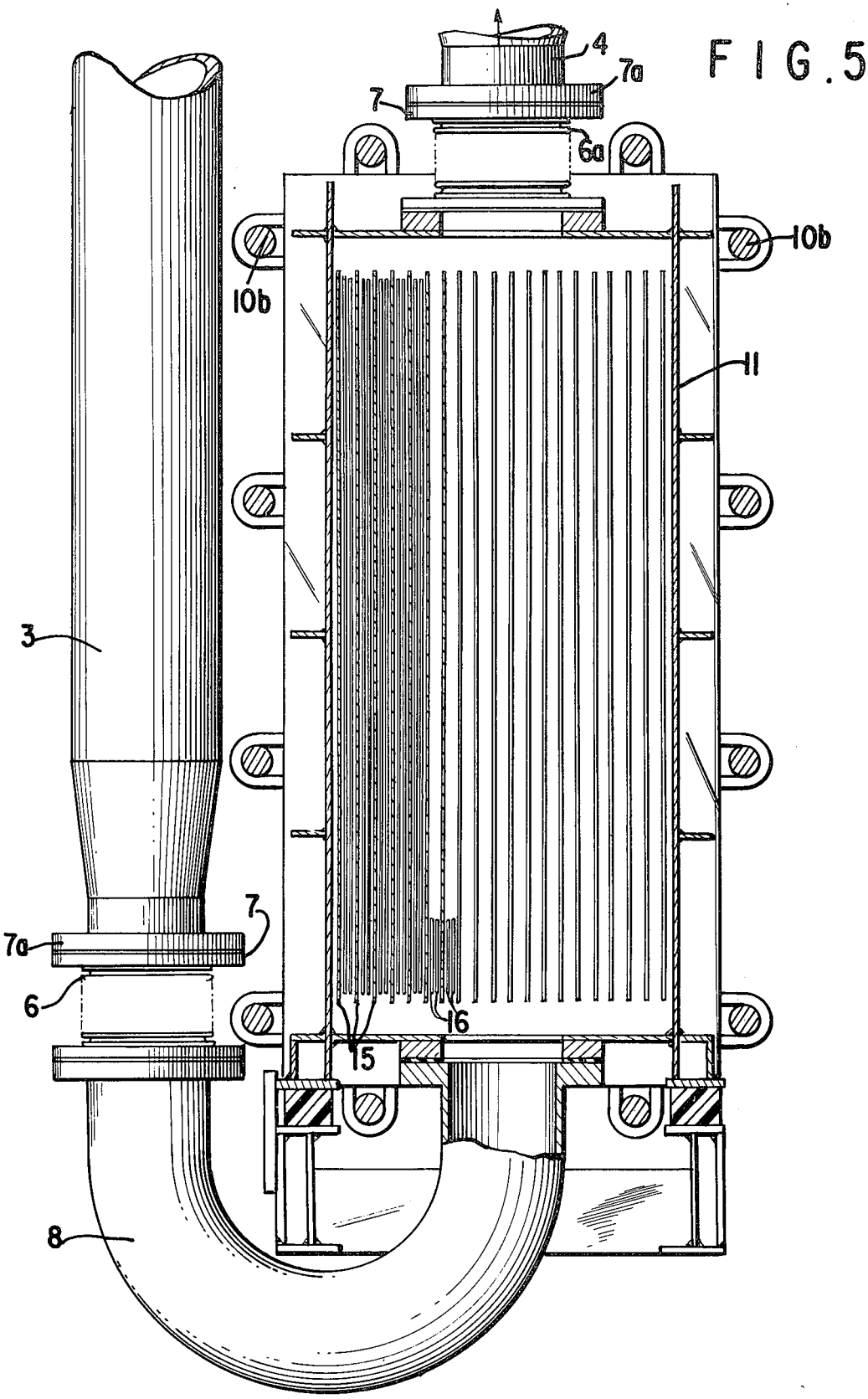
FIG. 5 is a vertical sectional view taken along the line 5—5 of FIG. 3.
Figure 7:
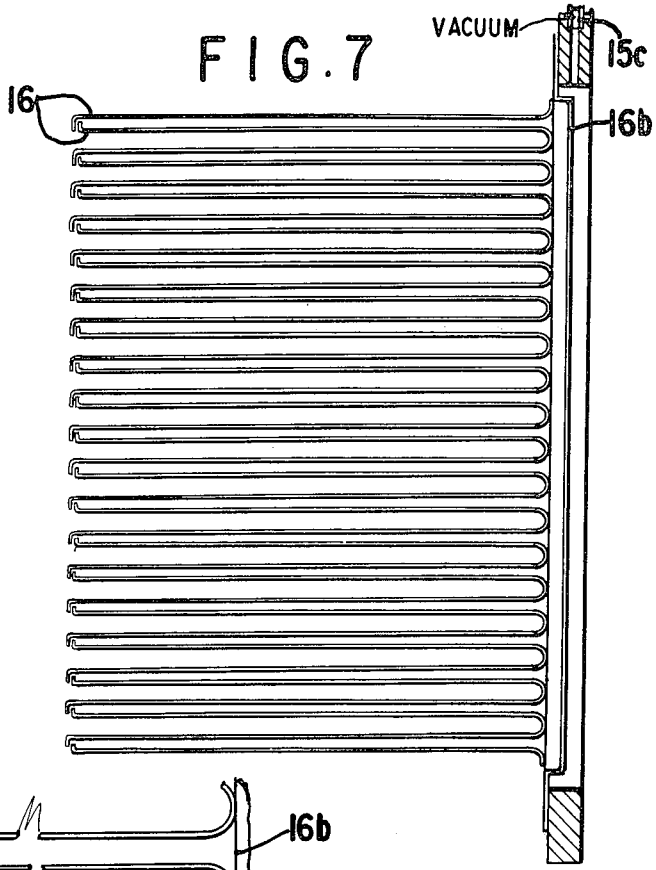
FIG. 7 is a plan view of a cathode bank.
Figure 6:
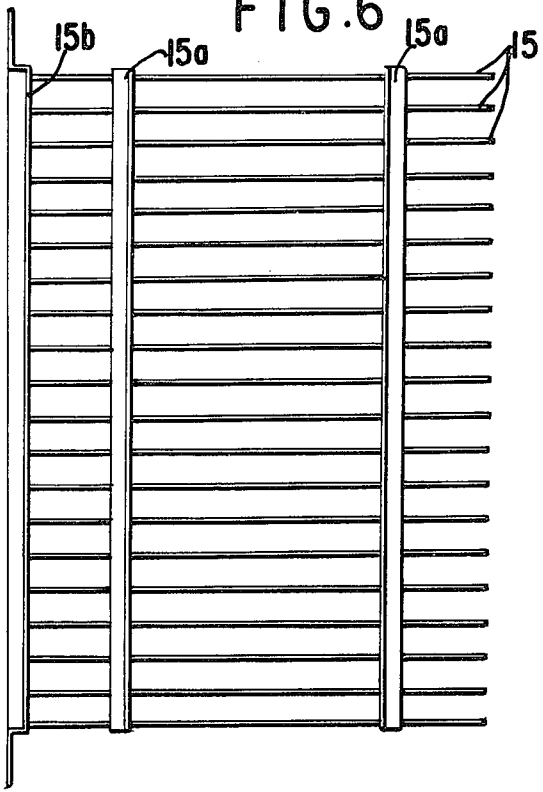
FIG. 6 is a plan view of one anode bank.

The construction of the cell units 1*a*, 1*b*, etc. are shown in greater detail in FIGS. 3 to 8, inclusive. Each of the bipolar cell units 1*a* to 1*j* consists of interleaved anode and cathode plates 15 and 16. THe anode plates or leaves 15 are held in parallel spaced relation as illustrated in FIG. 6 by bracer members 15a and the parallel cathode plates or leaves 16 fit between the anode plates or leaves as illustrated in FIGS. 3 and 5. The spacing between the plates is approximately 6 – 10 mm. The anode leaves are welded to a corrugated back plate 15*b* having nearly square faced corrugations therein and the cathode leaves are welded to a similarly corrugated back plate 16*b*. In assemblying the anode - cathode units 15 and 16, the cathode plates 16*b* of FIG. 7 are pushed between the anode plates 15 of FIG. 6 and are equally spaced from each anode plate as illustrated on a smaller scale in FIGS. 3 and 4.

For a given capacity, for example, 37.500 amp., a set of anodes 15 may be composed, for example of twenty titanium sheets, 2 mm thick by 1,000 mm high by 300 mm wide, welded in parallel and equally spaced on corrugated titanium back plates 15*b*, which are 1.5 mm thick. Instead of welding the titanium sheets directly to the back plates 15*b*, they may be bolted to titanium strips, which are welded to the back plates.

Figure 8:
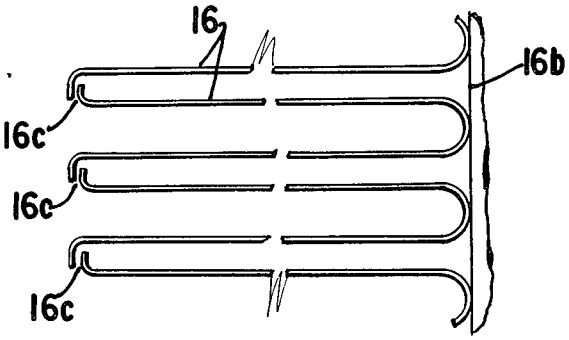
FIG. 8 is an enlarged view of a section of a cathode bank.

The corresponding cathode is comprised of nineteen steel cathode leaves 16, of corresponding size, welded on one side of a corrugated steel back plate 16*b* of a thickness of 1.5 to 2 mm. The twentieth cathode leaf is formed by the insides of the steel enclosure box 11. Each cathode leaf is preferably made of two sheets of reticulated and expanded steel, preferably stainless steel, as illustrated in FIG. 8, which together form a type of narrow box whose two faces work together with the opposite anode faces.

In the assembly shown in FIGS. 3 and 4, the corrugations of an anode back plate 15*b* abuts against the matching corrugations of a cathode back plate 16*b* between units 1a and 1*b* to form a bipolar connection between the cathode of cell unit 1*a* and the anode of cell unit 1*b*. The same type bipolar connection is made between cell units 1*b* and 1*c*, between cell units 1*c* and 1*d*, and so on, throughout the cell unit assembly shown in FIGS. 1, 3 and 4. The individual cells 1*a*, 1*b*, 1*c*, etc. may, however, be separated and the electrical connections between the cell units be made as a unipolar connection.

Before assembly, the square faced corrugations of back plates 15*b* and 16*b* are sprayed or otherwise coated with a layer of soft, electrically conductive metal, such as lead, copper, silver, tin or the like, to promote good electrical conduction between the back plates forming the bipolar connection between each of the cell units. In use, vacuum connections 15*c* are connected to a suitable vacuum system (not shown), used to create a vacuum between the corrugated back plates 15*b* and 16*b* to bring the squared corrugations into firm contact, the pressure of the electrolyte on the other side of the vacuum held back plates assists in maintaining this connection. A vacuum of 700 mm mercury is usually sufficient to maintain this connection. When, however, the vacuum is broken, in disassembling a cell, the back plates 15*b* and 16*b* can be readily separated as there are no complicated mechanical connections to remove, as in previous bipolar cell constructions. The use of a soft metal between corrugations of back plates 15*b* and 16*b* also prevents migration of hydrogen from the steel cathodes into the anodic titanium, where it might destroy the titanium parts by formation of titanium hydride. If ever needed for mechanical or other reasons, thin sheets or nibs of metal such as copper or other soft metals which have a low solubility for hydrogen, may be inserted between the bipolar back plates 15*b* and 16*b*.

The anode leaves 15 are preferably made of sheet or reticulated mesh titanium, titanium rods or other forms of titanium or tantalum or alloys of titanium or tantalum and before assembly into the cell are coated with an electrically conducting electrocatalytic coating of a platinum group metal or a mixture of oxides of an electrocatalytic metal and conductive oxides or compounds of other metals such as titanium, tantalum or the like. An electrocatalytic metal is any metal or oxide capable of catalyzing the transformation of chloride ions, formed at an anode surface, into chlorine molecules which are released into the electrolyte. No diaphragm is used in a chlorate cell.

The cathode leaves or plates 16 are preferably formed of steel or other ferrous metal, which may be in screen or other open form or in solid form. The cathode leaves are welded to the corrugations of the steel cathode back plates 16*b* and are preferably formed of separate waves welded at their base to the back plate 16*b* and separated at their crest, as indicated at 16*c* in FIG. 8, so that less trouble is encountered due to expansion and contraction in the welding or other manufacturing steps or in service. Instead of welding the cathode leaves 16 to the back plates 16*b*, the leaves may be bolted to steel strips which are, in turn, welded to the back plates. The vacuum held electrical connection between the back plates 15*b* and 16*b* also allows for creep and other distortions between these back plates in service.

The up-comer pipes 4 are essentially in the center of the top of cell units 1*a*, 1*b*, etc., so that the electrolyte buoyed upwardly by the $H_2$ or other gas therein, flows into the tank 2 and after separation of the gas flows down in in pipes 3 which are located to one side of the cell units 1*a*, 1*b*, etc. and connected to the center of the bottom of the cell units by elbows 8.

Brine is fed into the elbow of the first unit 1a as indicated at 19 (FIG. 3) and depleted brine containing chlorate in solution is removed from chamber 2*g* of the circuit of the last unit 1*h* at 13. The brine could, however, be fed into the circuit of any of the units and the chlorate solution removed at any other point and the electrolyte could be circulated by pump instead of by the lifting effect of the $H_2$ or other gas.

The down-comer pipes 3 are each provided with a titanium section 3*a* (FIG. 9) which is water cooled by means of a spray collar 3*b* which sprays cooling water all around the titanium section 3*a*. The cooling water after flowing down the section 3*a* is caught in a circular trough 3*c* and discharged through outlet 3*d*. If necessary, the electrolyte in up-comer pipes 4 may be cooled by means of a cooling tube 4*a* into which cooling water is introduced at the top and discharged from the side as shown in FIG. 10. Pressure gauges 2p in the tanks 2 show the amount of hydrogen or other gas pressure on the electrolyte.

The cell units 1a, lb, etc. are mounted on steel supports 9 and suitably electrically insulated therefrom by stenite plates 9*a* and are held between positive and negative end plates 10 and 10*a* connected into the electrical circuit by terminals 10*c* and 10*d*. Tie rods 10*b* hold electrolyzers 1*a* to 1*g* together. The anodes and cathodes of the cell unit 1*a*, 1*b*, etc. are mounted in steel boxes 11, resting on supports 9, so that an entire electrolyzer of cell units 1*a* to 1*j* may be disconnected and removed from the circuit for repair or replacement as needed. The steel boxes 11 are separated by insulating rubber gaskets 11*a*.

OPERATION

The electrolyte may be circulated by any desired means. However, circulation by the rising $H_2$ bubbles in pipes 4 is economical and leaves the down-comer tubes 3 full of compact electrolyte having only a small quantity of gas bubbles therein. In the electrolyzers 1*a*, 1*b*, etc. NaCl is electrolyzed with the production of chlorine at the anodes and hydrogen and NaOH at the cathodes by the well known chlorine cell reactions. The hydrogen bubbles drive the recirculation of the electrolyte through pipes 4 and 3. In the tanks 2, The $H_2$ bubbles are separated from the electrolyte and the electrolyte continues to recirculate through cell unit 1a, a small amount of electrolyte from the circuit of cell unit 1a flows self-regulated through the openings 5 or other openings in partitions 12 into the electrolyte circulation of cell unit 1*b* and so, through the electrolyte circulation of cell units 1*c* to 1*j*, and out of opening 13. To start the plant in operation, all the circuits are filled with electrolyte from brine feed inlet 19. After operation at a steady state has been reached, the chlorate concentration in each circuit from 1*a* to 1*j* is larger and reaches its highest value in the electrolyte circuit of cell unit 1j. After crystallization of solid chlorate or removal of the bulk of the chlorate content of the electrolyte flowing from outlets 13 by another method, the electrolyte containing about 100 to 120 g/l of residual $NaClO_3$ is resaturated with NaCl and fed into cell unit 1*b* through the brine feed inlet 19. Some water has to be added in order to compensate the $H_2O$ losses caused by the consumption in the cells and by evaporation with the hydrogen. The electrolyte makes many cycles of recirculation through each of the cell units 1a to 1j, with further electrolysis and removal of $H_2$ gas in each recirculation through the cell units 1*a* to 1*j* until the desired concentration of $NaClO_3$ is reached and the final electrolyte discharge through outlet 13.

Operation and control of such an electrolyzer is extremely simple, because the flow meter which indicates the brine feed into the electrolyte chamber 1a is adjusted at such a rate that at a certain current load on the electrolyser, the $NaClO_3$ solution leaving the chamber 1*j* has the desired $NaClO_3$ concentration and a NaCl concentration of not less than about 100 – 120 g NaCl/liter.

The current in each cell unit is the same and the current efficiency in the different cell units 1*a* and 1*j* approximately the same, the increment of the $NaClO_3$ concentration added to the electrolyte in each cell unit is also approximately the same. However, this is not important because the feed brine rate into cell unit 1a is adjusted to maintain the above stated $NaClO_3$ and NaCl concentrations in the electrolyte leaving chamber 1*j* through outlet 13.

The high electrolyte columns (approximately 8 – 15 m or more) in the up-comer and down-comer pipes 4 and 3 give a further advantage as they create a static overpressure in the electrolyzer element, equal to about one or more atmospheres above the natural atmosphere, and consequently the volumes of the hydrogen bubbles with the $H_2O$ vapor inside the electrolyzer element are reduced to a fraction of the volume they would have without this substantial overpressure. While the bubbles rise from the electrolyzer element up into the gas separation chambers 2, they grow in size because the overpressure disappears gradually. By this pressure release the volume of the bubbles increases not only proportionally to the pressure reduction, but much more, according to the absolute value of the electrolyzer temperature as shown in the following table, for an assumed overpressure of 1 atm. on the upper end of an electrolyzer element.

| Electrolyzer Temperature | Relative Gas Bubble Volume ($H_2 + H_2O$ Vapor) In the Electrolyzer | Close to Upper End Of Up-Comer Pipe 4 |
|---|---|---|
| 70° C | 1 | 2.2 |
| 80° C | 1 | 3.2 |
| 90° C | 1 | 4.8 |
| 100° C | 1 | 9 |

The large relative ($H_2 + H_2O$ vapor) volume (in relation to the $H_2$ volume at the same temperature) indicated in the table under "Close to Upper End of Up-Comer Pipe 4". would exist also in the electrode gaps of each electrolyzer element, if they were operated at atmospheric pressure instead of overpressure, for example, at 80° C, the gas volume present in the electrode gaps is 3.2 times lower at an overpressure of one atmosphere than it would be at a cell pressure of normal atmosphere.

The reason for this is the steeply increasing $H_2O$ vapor pressure with temperature. For this reason, the electrolyzer temperature should not be higher than about 80°C.

The unfavorable influence of the hydrogen + $H_2O$ vapor bubbles contained in the electrolyzer elements on the electric conductivity of the electrolyte is reduced appreciably relative to its value at atmospheric pressure in the electrolyzer by the use of the hydrostatic head of about 10 meters and this results in an appreciable saving of cell voltage, i.e. power consumption.

In practice, the temperature in the electrolyzer elements can go as high as about 80° C, due to the overpressure and to the use of the metal anodes and it should not be less than about 70° C in order to maintain a sufficient speed of the chemical reaction hypochlorite → chlorate ($2HClO + NaClO = NaClO_3 + 2HCl$).

A further advantage of the overpressure in the electrolyzer is that the adverse effect of this high cell temperature on the solubility of the anodic chlorine gas in the electrolyte and consequently on the reaction speed between NaOH and dissolved chlorine is at least partially compensated by the overpressure.

Due to the high operation temperature of more than 60° C, the dwelling time of the hypochlorite in the relatively small electrolyte volume in each cell unit 1*a* to 1*j*, is sufficient for the chemical reaction rate and so the bulk of hypochlorite and hypochlorous acid formed in one cell unit (during recirculation) is transformed into chlorate before the electrolyte passes over into the next cell unit.

With a high operation temperature of about 80° C (which would be undesirable without the overpressure as above explained), only a reduced heat echanger surface for the artificial cooling of the electrolyte is needed in the down-comer pipes 3, on account of the higher temperature difference between electrolyte and the normally available cooling water.

While the apparatus of this invention has been described in considerable detail and many of the advantages set forth, it will be understood that many changes and modifications of the embodiments described can be made and that unipolar instead of bipolar electrolyzers may be used within the scope of the invention and the following claims.

What is claimed is:

1. In a chlorate electrolyzer, a series of bipolar connected electrolyzer cell units, each cell unit containing dimensionally stable metal anodes and cathodes in leaf form with the leaves of the cathode extending between the leaves of the anode and uniformly spaced therefrom, a cathode back plate supporting the cathode leaves, an anode back plate supporting the anode leaves, said back plates being in electrical connection with each other to form the bipolar connection between the cell units, a gas separation tank above said cell units, means to connect said cell units and said gas separation tank comprising a riser connection from the top of each of said cell units to the bottom of said tank, a down-comer connection from said tank to the bottom of each of said cell units, separating partitions in said gas separation tank, separating said tank into individual compartments connected to the riser and down-comer of each of said cell units, thereby forming separated circulation paths between each of said cell units and its connected gas separation compartment in said gas separation tank, means in said separating partitions to permit controlled flow from one circulation path to another and means in said tank to prevent direct flow from said riser connection to said down-comer connection.

2. The cell of claim 1, in which the cathode and anode back plates are steel and titanium and are separated by an intermediate metal from the group consisting of lead, copper, silver and tin.

3. The cell of claim 1, in which the anode leaves are titanium coated with an electrically conducting electrocatalytic coating and the cathode leaves are of ferrous metal.

4. The cell of claim 1, in which means are provided to maintain the cell units under superatmospheric pressure.

5. The cell of claim 1, in which means are provided in the connections between the cell units and the common gas release chamber, to cool the electrolyte flowing between said cell units and said gas release chamber.

6. The cell of claim 1, in which said riser connections and said down-comer connection are chemically inert to the reaction products of said cell units and are electrically insulating.

7. The cell of claim 1, in which said riser connections and said down-comer connection are connected to said cell units by bellows connections to allow for expansion and contraction and disconnectable flanges for said connections to permit ready disconnection of a cell unit.

8. The cell of claim 1, in which each of the series of cell units is connected to a common gas release chamber located from 8 to 15 meters above the series of cell units, and the gas release chamber has a hydrogen discharge conduit and a chlorate solution outlet.

9. The cell of claim 8, in which the hydrogen discharge conduit of the gas release chamber has a throttle valve, to throttle the discharge of hydrogen through said conduit.

10. An electrolyzer comprising a series of parallel compartments in which adjacent compartments are separated from each other by a common bipolar electrical connection, one face of which is the anode for a compartment and an opposite face of which is the cathode for an adjacent compartment, a separate enclosure for each compartment, a gas separation container above said compartments, paired down-comer and up-comer means for each compartment in which the down-comer means at the upper end thereof connect with said separation container forming an electrolyte separation container outlet and at the lower end thereof connect with the base of a parallel compartment forming a compartment inlet and the up-comer means at the upper end thereof connect with said separation container forming an electrolyte separation container inlet, and at the lower end connects with the top of said parallel compartment forming an electrolyzer compartment outlet, said down-comer means and up-comer means forming part of a circulation system for circulating and recirculating electrolyte between and through each of said compartments and said separation container, a terminal anode mounted opposite a bipolar cathode of a terminal compartment at one end of said series of compartments, a terminal cathode mounted opposite a bipolar anode of a terminal compartment at an opposite end of said series, a feed inlet means for feeding a feed brine into said circulation system of at least one of said compartments, a product withdrawal oulet for withdrawing a liquid from said separation container, a gas vent for venting gas collected within said separation container, an electrical circuit for supplying current to said terminal anode and for withdrawing current from said terminal cathode, said separation container defining an enclosed space and transverse walls in said separation container separating said separation container into liquid retaining spaces to connect with the up-comer and down-comer means of the same electrolyzer compartment.

11. The apparatus of claim 10, in which for each paired preceding and successive circulation system in series, a transverse wall separating the paired systems is perforated, said perforations permitting a predetermined amount of electrolyte to pass through said transverse separation walls.

12. An electrolyzer combination according to claim 10, in which for each of said compartments a single pair of down-comer means and up-comer means communicates with a single one of said compartments.

13. An electrolyzer combination according to claim 10, in which said anodes comprise a plurality of substantially upright parallel anode plates and said cathodes comprise a plurality of substantially upright parallel cathode plates, such that substantially upright flow channels are formed between said anode and cathode plates.

14. An electrolyzer comprising a series of parallel compartments in which adjacent compartments are separated from each other by a common bipolar electrical connection, one face of which is the anode for a compartment and an opposite face of which is the cathode for and adjacent compartment, a separate enclosure surrounding each compartment, a terminal anode mounted opposite a bipolar cathode of a terminal compartment at one end of said series of compartments, a terminal cathode mounted opposite a bipolar anode of a terminal compartment at an opposite end of said series, a feed inlet means for feeding a feed brine into at least one of said compartments, a product withdrawal outlet in the top of each compartment for withdrawing a liquid from each of said series of compartments, a gas vent in each of said product withdrawal oulets for venting gas from each of said compartments, means to return liquid to each of said compartments, means to permit controlled flow of liquid withdrawn from one of said compartments into the next adjacent compartment, an electrical circuit supplying current to said terminal anode and for withdrawing current from said terminal cathode.

* * * * *